United States Patent [19]

Koppenberg

[11] Patent Number: 4,523,413

[45] Date of Patent: Jun. 18, 1985

[54] HANGER FASTENER

[76] Inventor: Bruce G. Koppenberg, 9675 Mt. Baker Hwy., Deming, Wash. 98244

[21] Appl. No.: 476,592

[22] Filed: Mar. 18, 1983

[51] Int. Cl.[3] ..... E04B 1/40

[52] U.S. Cl. ..... 52/139; 52/137; 52/509; 52/702; 52/704

[58] Field of Search ..... 52/133, 134, 135, 136, 52/137, 138, 139, 506, 509, 512, 702, 704, 235; 248/287

[56] References Cited

U.S. PATENT DOCUMENTS

| | | | |
|---|---|---|---|
| 2,080,190 | 5/1937 | Sinner | 52/702 X |
| 2,574,938 | 11/1951 | Sinner et al. | 52/704 X |
| 3,213,576 | 10/1965 | Davies | 52/139 X |
| 3,342,005 | 9/1967 | Richards et al. | 52/509 X |
| 3,990,199 | 11/1976 | Gallo | 52/139 X |

*Primary Examiner*—Donald G. Kelly
*Assistant Examiner*—Richard E. Chilcot, Jr.
*Attorney, Agent, or Firm*—Kolisch, Hartwell & Dickinson

[57] ABSTRACT

A slab hanger-fastener for supporting and securing shutter slabs over mausoleum vaults or niches. The device is structured so that it may be used to secure shutter slabs at the corners or intermediate portions of the slabs. A mechanism of the same design and construction may be used to secure slabs at the end, bottom and top margins of a vault or niche structure. The support member of the mechanism is adjustable relative to the walls of the vault or niche and may be securely locked in desired position with a solitary locking mechanism.

4 Claims, 8 Drawing Figures

FIG. 1
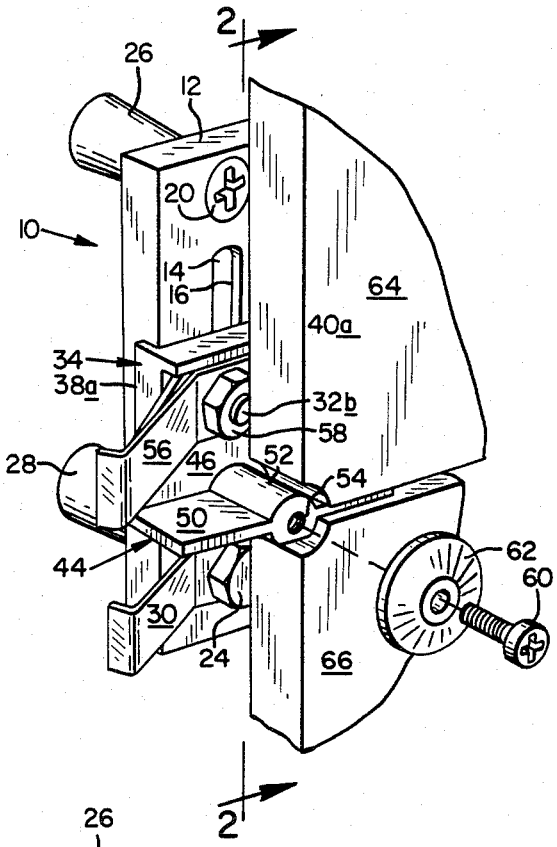
FIG. 2
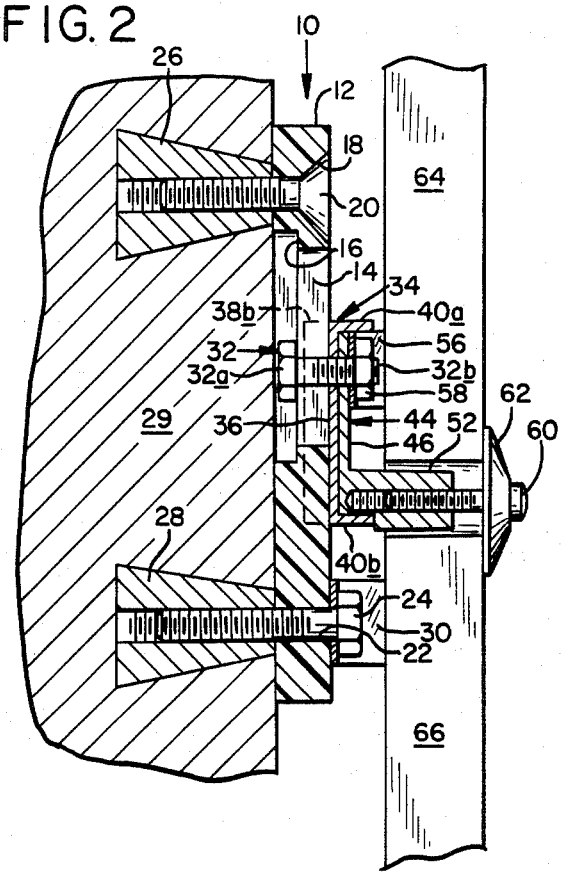
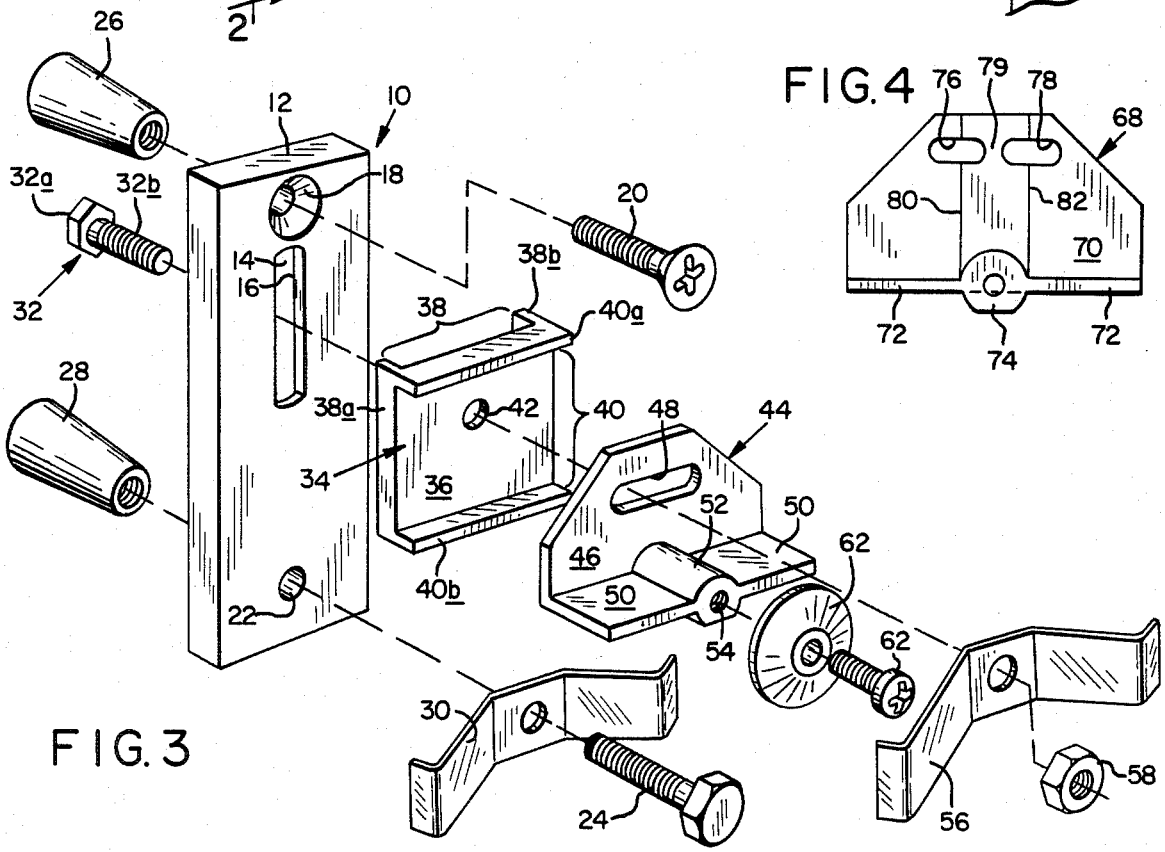
FIG. 3
FIG. 4

HANGER FASTENER

BACKGROUND AND SUMMARY OF THE INVENTION

The present invention pertains to a device for hanging and securing slabs to a vertical surface. More particularly, the device is used with marble and granite shutter slabs of the type used to cover mausoleum vaults or cremation niches.

The usual form of an above-ground mausoleum or a series of cremation niches consists of a series of vaults or niches which will contain burial caskets or cremation urns. A series of vaults or niches will be located within one structure, arranged side-by-side and above one another. An individual vault or niche will share side, top and bottom walls with adjacent vaults or niches. Construction and use of the vaults or niches is essentially similar, therefore, the word "vaults" as used hereinafter will be considered interchangable with the word niche unless a specific distinction is made.

Individual vaults are made from pre-formed or poured concrete. The completed structure contains a series of cubby-hole units which essentially resemble a bank of post office boxes. After completion of the structure, and before entombment of any remains, the openings are covered with marble or granite slabs. Attachment and adjustment of the slabs is accomplished by means of slab hanger-fasteners. Generally, each vault is covered by a separate shutter slab.

Slab hanger-fasteners are located at each corner of an individual vault. With this arrangement, a slab hanger-fastener located at a central position of the mausoleum will fasten and support four individual shutter slabs—a four-corner attachment position. Hanger-fasteners located at the top, base or ends of the mausoleum structure will support and fasten two shutter slabs.

When an above-ground mausoleum is constructed, anchor members are positioned in the vault walls prior to the pouring of the concrete which forms such walls. Upon completion of the concrete framework, the vaults are covered with marble or granite shutters which may be subsequently carved to indicate the name of the person entombed therein. Since all of the vaults are not immediately filled, it is necessary for cemetery proprietors to remove the shutters on the occasion of placing a casket within the vault. Once the vault is filled, it is sealed with a concrete closure slab, the marble or granite shutter is carved with the desired inscription, and the shutter is replaced as a facade over the closure slab.

As might be expected, the placement of the shutter slab requires that the shutter slab support mechanism be adjustable to account for variations in the slab dimensions and the settling of the mausoleum structure on the ground.

Known prior art is capable of performing the aforementioned functions; however, prior art has several drawbacks in regard to adjustment and securing the shutter slabs to the mausoleum walls. Known prior art requires a variety of fastener-supports, depending on the position of the support unit on the mausoleum structure and its function in relation to the shutter slab; i.e., a different type of support structure is required at a four-corner attachment position, a side-edge attachment position, and bottom and top attachment positions. Also, the the prior art support units used for mausoleum vaults are far too massive to be used with cremation niches, even though a single stone slab is generally used to cover several niches.

A general object then, of the present invention, is to provide an improved means of fastening and supporting shutter slabs which utilizes a single type of supporting and anchoring device, usable in all attachment positions of the mausoleum structure. The means may be constructed so as to be usable to attach both vault facings and cremation niche facings.

The adjustment capability of prior art generally involves separate adjustments for vertical and horizontal movement of the support mechanism. Vertical adjustment has generally required the manipulation of multiple tightening nuts while horizontal adjustment has generally required the application of a striking force to the slab support structure. Obviously, it would require an individual of great manual dexterity to accomplish both vertical and horizontal adjustment simultaneously. Over the course of time, as the walls of the mausoleum settle, it may be expected that some tilting ot the wall occurs, in which case the vertical adjustment also contains a horizontal component and likewise the horizontal adjustment contains a small vertical component.

A specific object of the present invention is the provision of means permitting simultaneous vertical and horizontal adjustment of the support structure in relation to the walls of the mausoleum, and then securing the slab hanger-fastener in the desired position by means of a single locking device.

Various other features and advantages which are attained by this device will become more fully apparent as the description which now follows is read in conjunction with the accompanying drawings.

BRIEF DESCRIPTION OF THE DRAWINGS

FIG. 1 is a perspective view of the slab hanger-fastener as it would be assembled for a four-corner attachment position, two of the four slabs not being shown in order to better reveal the hanger-fastener.

FIG. 2 is a median cross-sectional view taken along line 2—2 in FIG. 1, slightly enlarged.

FIG. 3 is an exploded perspective view of the device.

FIG. 4 is a frontal elevation of a modified form of slab support member present in the assembly.

DETAILED DESCRIPTION OF THE PREFERRED EMBODIMENT

Figure 5:
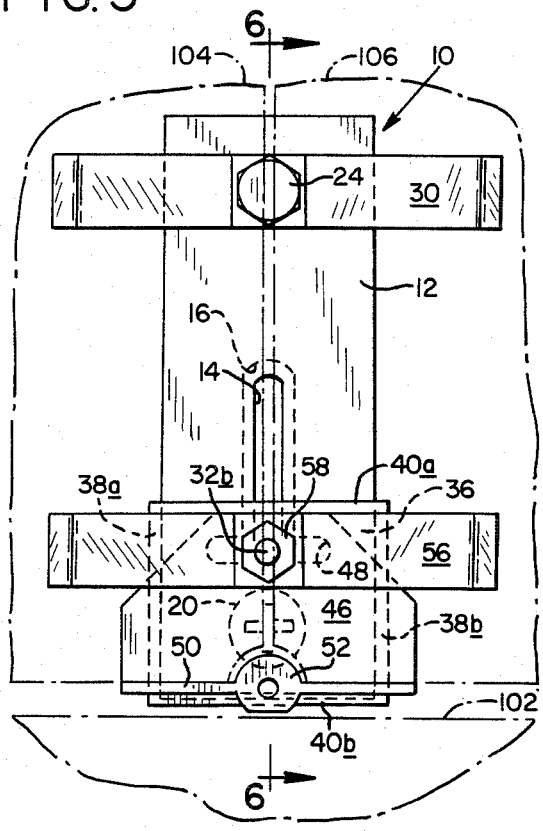
FIG. 5 is an enlarged frontal elevation of the device as assembled to support two adjacent slabs in the bottom-most attachment position of the mausoleum.

Turning to FIGS. 1–3, inclusive, a slab hanger-fastener is indicated generally at 10. The fastener includes an elongate rectangular frame plate 12, containing a central frame plate adjustment slot 14 with a countersunk margin 16 on the rear of plate 12. A beveled anchor screw hole 18 is located at one end of the frame plate intermediate the frame plate edges. Screw hole 18 receives a countersunk anchor screw 20. At the opposite end of the frame plate, intermediate the frame plate edges, is an anchor bolt hole 22, which receives an anchor bolt 24. Screw 20 and bolt 24 are threadably received within anchors 26 and 28, which are permanently incorporated into a vault wall 29. Screw 20, bolt 24 and anchors 26, 28 comprise anchor means or mounting means. A first slab positioning spring 30 is fastened to frame plate 12 by means of anchor bolt 24.

A fastener 32, which includes a hexagonal head 32*a* and a threaded shank 32*b*, is used for part of the fastener means in the preferred embodiment. Head 32*a* seats within countersunk margin 16 and shank 32*b* extends through frame plate slot 14.

Shown at 34 is a guide member comprised of a guide member plate 36, a rear channel 38 which is defined by vertical flanges 38*a*, 38*b*, a front channel 40, perpendicular to the rear channel, which is defined by horizontal flanges 40*a*, 40*b*, and a guide member bore 42. Guide member 34 is slidably mounted on the front of frame plate 12, the frame plate being received within rear channel 38 and guide member bore 42 receiving threaded shank 32*b*. The guide member may thus slide along the frame plate, its travel being limited within the ends of the frame plate by the length of frame plate slot 14. Vertical flanges 38*a*, 38*b* prevent rotation of the guide member about threaded shank 32*b* and also define the path over which the guide member and the frame plate may move relative one another.

A slab support member 44 is received in the front channel of the guide member. The slab support member includes a support plate 46 which receives threaded shank 32*b* through a support plate slot 48. Slot 48 is parallel to front channel 40. An elongate slab support flange 50, which acts as a slab positioning means, extends perpendicular to support plate 46, paralleling front channel 40, and includes a post portion 52 intermediate its ends. The post portion contains an internally threaded bore 54. A second slab positioning spring 56 receives threaded shank 32*b*. A machine nut 58, is threaded on the end of shank 32*b*, completing the fastener means, thereby securing the frame plate, the guide member, the support member and the second slab positioning spring together.

Shown at 60 is a retainer screw, and at 62 a rosette having a bore extending through the center thereof. When assembling the hanger-fastener, the screw passes through the center of the rosette and is screwed into threaded bore 54 of post portion 52. The rosette comes up against outer faces of slabs 64, 66 which are fastened and supported by the hanger-fastener. Screw 60 and rosette 62 comprise a retainer member.

Another form of slab support member is shown in at FIG. 4 at 68. This form may be used at side-edge attachment positions on the mausoleum. Slab support member 68 includes a support plate 70, a slab support flange 72 and a post portion 74. Two support plate slots 76, 78 are located in support plate 70. These slots are symmetrical about the support plate median web, shown generally at 79. Two cut lines 80, 82 are located on either side of post portion 74.

Figure 8:
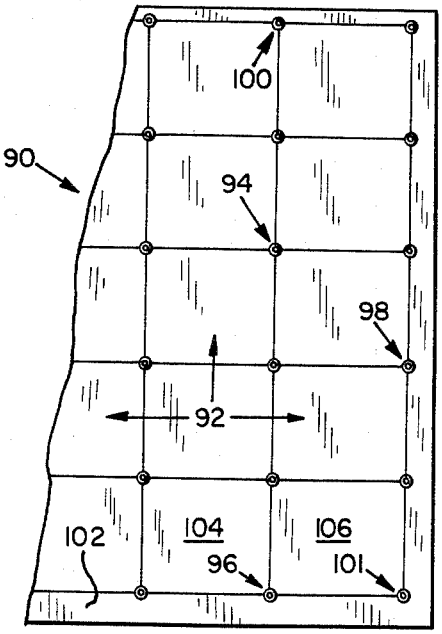
FIG. 8 is a simplified fragmented frontal elevation of a mausoleum structure.

Portions of a mausoleum structure are shown in FIG. 8 at 90. The mausoleum structure typically includes a series of vertical walls spanned by vertically spaced and horizontally extending decks which cooperate to define a series of cubicles arranged in tiers opening up to a side of the mausoleum. The open end of these cubicles are closed off by rectangular slabs as exemplified by slabs 92 in FIG. 8. The hanger-fastener which has been described above is utilized in securing these slabs in place on the mausoleum. The hanger-fastener, with only slight moditication, may be used with equal effectiveness in securing slabs at what is referred to herein as a four-corner attachment position, indicated at 94 in FIG. 8, in the securing of slabs at a bottom-most attachment position exemplified by location 96 in FIG. 8, in the securing slabs at a side-edge attachment position exemplified by position 98 in FIG. 8, in the securing of slabs at a top-most attachment position as exemplified by position 100 in FIG. 8, and in the securing of slabs at a combined bottom or top-most-side-edge attachment position as exemplified on position 101 in FIG. 8.

Further explaining, in securing slabs at what is referred to as the four-corner attachment position 94, the hanger-fastener may be assembled as shown in FIG. 1 and FIG. 2. With nut 58 loosened, guide member 34 and slab support member 44 are properly positioned to place post 52 at the location where the corners of four adjacent slabs come together. The nut is then tightened onto fastener 32 which secures the guide member and slab support member into place. The lower two slabs, which become mounted in place, have top edges which come up against the underside of flange 50 and inner faces that bear against the ends of spring 30, the latter being secured in place in the assembly by anchor bolt 24. The lower edges of the upper two slabs are adjacent the upper surface of support flange 50 and have inner faces bearing against the ends of spring 56 which is secured in the assembly by fastener 32 and nut 58. The retainer screw 60 is screwed into bore 54 to bring rosette 62 firmly against the outer faces of the four slabs.

Figure 6:
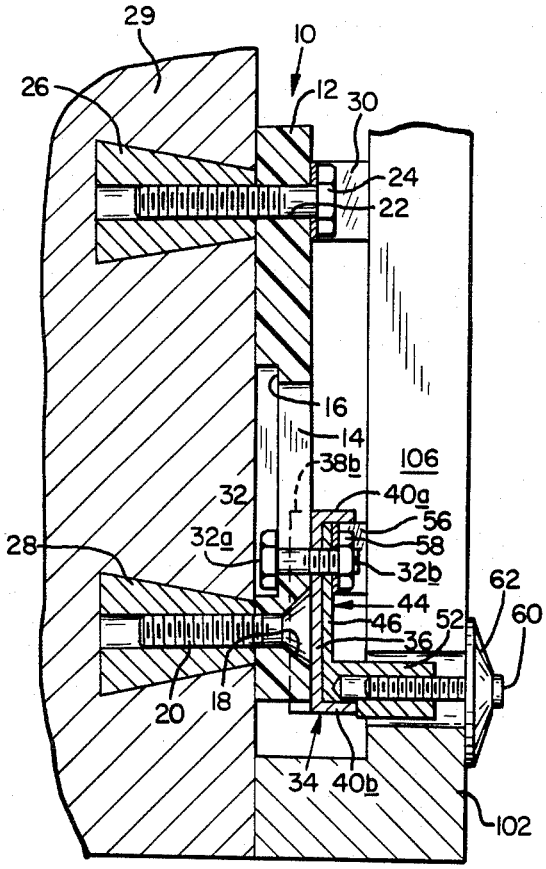
FIG. 6 is a median cross-sectional view taken along line 5—5 in FIG. 5.

Considering now the securement of slabs at a bottom-most attachment position 96, such is done with the hanger-fastener assembled as shown in FIG. 5 and FIG. 6. In this instance, frame plate 12 may be inverted from the position shown in FIG. 1. Spring 30 again is held in place by anchor bolt 24 but with the frame plate inverted now appears at the top of the assembly. The guide member 34 is adjusted downward on the frame plate to a lowered position, which is possible because of countersunk anchor screw 20. Slab support member 44 becomes positioned with slab support flange 50 directly adjacent the base of the frame plate which is substantially immediately adjacent the base 102 of the mausoleum. Two slabs, such as those indicated at 104 and 106 are positioned with their lower edges on the top of slab support flange 50, and with attachment of the rosette to the post utilizing retainer screw 60 inner faces of the slabs bear against the ends of spring 56 as well as the ends of spring 30.

It should be apparent that the hanger-fastener is equally well-used in the attachment of two slabs in an upper-most attachment position as exemplified by location 100. In this type of installation, the assembly essentially is merely inverted from the position shown in FIG. 5 to place anchor bolt 24 and spring 30 at the base of the assembly and the guide member and slab support member adjacent the top of the assembly.

Figure 7:
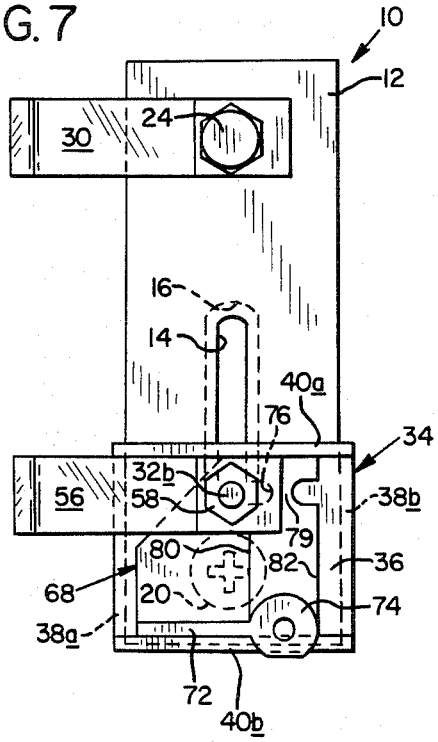
FIG. 7 is a frontal elevation of the device as assembled for use on the side edge of a mausoleum.

In connecting a slab as at bottom-most-side-edge attachment position 101 shown in FIG. 8, the frame plate is positioned on the mausoleum as shown in FIG. 7. The guide member and slab support member are secured with such position adjacent the base of the frame plate, as in the case of the assembly shown in FIG. 5. In this instance, however, and to avoid protuberance in the slab support member outward to one side of the mausoleum, a support member such as shown in FIG. 4 may be utilized with the support member cut off as by cutting it along cut line 82 shown in FIG. 4. Again, to avoid extension of a spring end beyond the side of the frame plate, springs 30 and 56, which have had one set of their ends removed, may be used. In connecting a slab at side-edge attachment position 98 shown in FIG. 8, the hanger-fastener B assemble as shown in FIG. 1, with support member 68 and springs 30, 56 cutoff as shown in FIG. 7.

It should be apparent from the above discussion that the hanger-fastener of the invention is readily mounted on the mausoleum with adjustments then easily made to place the slab support member and guide member in proper position for the reception of the slabs that are to be fastened in place with the assembly. Whereas prior art approaches have necessitated the use of essentially distinctively different types of fastening and support means, depending upon the number of panels being secured in place and the position where the attachment occurs, the hanger-fastener of the invention is readily adapted for use at all locations with only minor modification required in limited instances.

The wide variety of materials incorporated into the mausoleum, i.e., concrete vault walls and closure slabs, the metallic parts of the hanger-fastener, and the marble of granite shutter slabs, necessitate a flexible yet sturdy means of affixing the components to one another, as a completely rigid affixation method could result in destruction of one or more components as the result of expansion and contraction forces as the ambient air temperature and the temperature of the components change. It can be seen from the invention as embodied, that the shutter slabs are securely attached to the mausoleum, while allowing changes in slab dimensions resulting from thermal changes in the environment.

While a preferred embodiment of the device has been described herein, it is appreciated that variations and modifications may be made without departing from the spirit of the invention.

It is claimed and desired to secure by Letters Patent:

1. A slab hanger-fastener comprising:

a frame plate, means for mounting the frame plate against a support surface, a guide member mounted on the frame plate for movement in a path extending between the ends of the frame plate, said guide member including means forming a rear channel on one side thereof which receives the frame plate and confines the guide member to movement in said path, a slab support member mounted on the guide member for movement in another path extending transversely of said first-mentioned path, said guide member having means forming a front channel on the opposite side of the guide member which receives the slab support member and confines the slab support member for movement in said other path, fastener means for securing together in fixed position said guide member and slab support member on said frame plate, said slab support member including slab positioning means on the front thereof for positioning slab edges, and a retainer member detachably mounted on the slab support member.

2. The slab hanger-fastener of claim 1 wherein said frame plate has a slot therein extending between the ends of the frame plate generally in the direction of said first-mentioned path, said slab support member has a slot therein extending generally in the direction of said other path, said guide member has a bore generally registering with the slots in said frame plate and said slab support member and said fastener means seats within said slots and said bore.

3. A mechanism for securing slabs to vertical surfaces:

a generally elongate frame plate having front and back sides, said frame plate having an adjustment slot extending along its length, said adjustment slot having a countersunk margin on the back side of said frame plate, means for anchoring the frame plate to a vertical surface comprising fasteners extending through the frame plate at locations disposed beyond the ends of said slot, a guide member having means froming a rear channel on the back of the guide member, said guide member being mounted on the frame plate with said rear channel receiving the frame plate, said guide member further having means forming a front channel on the front of the guide member, extending generally normal to the rear channel, a slab support member mounted on said guide member received within the front channel, said slab support member having an elongate flange, which supports such slabs, generally paralleling said front channel, said flange including a post portion intermediate its ends, said post portion detachably receiving a slab retainer member which secures such slabs to said slab hanger-fastener, said guide member and frame plate being relatively movable in a path defined by said rear channel and the slab support member and guide being relatively movable in a path defined by said front channel, a bore in said guide member generally registering with said slot and another slot in said support member extending generally in the direction of said front channel registering with said bore, a fastener bolt having the head thereof seated within the countersunk margin of said first-mentioned slot and a shank extending through said first-mentioned slot, said bore and said second-mentioned slot, said shank terminating in a threaded end, and nut means screwed on said threaded of said shank serving releasably to secure the support member and guide member to said frame plate with different adjusted positions of said support member and guide member.

4. The mechanism of claim 3 wherein said support member includes two slots extending generally in the direction of said front channel, said slots being separated by a median web.

* * * * *